US005114539A

United States Patent [19]

Penniman et al.

[11] Patent Number: 5,114,539

[45] Date of Patent: * May 19, 1992

[54] METHODS FOR MANUFACTURING PAPER PRODUCTS

[75] Inventors: John G. Penniman, Carmel; Maria S. Reichlin, White Plains, both of N.Y.

[73] Assignee: Paper Chemistry Laboratory, Inc., Carmel, N.Y.

[ * ] Notice: The portion of the term of this patent subsequent to Aug. 4, 2004 has been disclaimed.

[21] Appl. No.: 224,225

[22] Filed: Sep. 9, 1988

Related U.S. Application Data

[63] Continuation-in-part of Ser. No. 77,149, Jul. 24, 1987, abandoned, which is a continuation-in-part of Ser. No. 806,884, Dec. 9, 1985, abandoned.

[51] Int. Cl.[5] ..... D21D 3/00; D21F 11/00

[52] U.S. Cl. ..... 162/184; 162/204

[58] Field of Search ..... 162/184, 185, 186, 158, 162/169, 173, 204, 199

[56] References Cited

U.S. PATENT DOCUMENTS

| | | | |
|---|---|---|---|
| 1,846,474 | 2/1932 | Darling | 34/9 X |
| 1,966,458 | 7/1934 | Novak | 162/184 X |
| 2,132,016 | 10/1938 | Du Bois | 162/135 X |
| 2,665,983 | 1/1950 | Bakalar | 162/173 |
| 2,683,087 | 7/1954 | Reynolds | 162/173 |
| 3,055,853 | 9/1962 | Pickell | 162/169 X |
| 3,293,115 | 12/1966 | Lucken | 162/184 |
| 3,374,550 | 3/1968 | Belleau | 34/9 |
| 3,491,457 | 2/1970 | Schreibert et al. | 34/1 |
| 3,494,826 | 2/1970 | Schreiber | 162/168 |
| 3,640,763 | 3/1972 | Lard | 117/126 GF |
| 3,800,433 | 4/1974 | Kubodera | 34/135 |
| 3,912,835 | 10/1975 | Uchida | 427/316 |
| 3,939,091 | 2/1976 | Kelly, Jr. | 252/189 |
| 4,113,506 | 9/1978 | Sackmann et al. | 106/238 |
| 4,198,267 | 4/1980 | Flaherty | 162/173 X |
| 4,304,626 | 12/1981 | Shaw et al. | 162/168 R |
| 4,323,490 | 4/1982 | Topfl | 523/409 |
| 4,332,748 | 6/1982 | Fremont | 264/11 |
| 4,338,352 | 6/1983 | Allan et al. | 427/391 |
| 4,376,048 | 3/1983 | Topfl | 260/404.5 |
| 4,379,882 | 5/1983 | Miyata | 524/436 |
| 4,383,860 | 8/1983 | Uhlemayr et al. | 106/27 |
| 4,465,856 | 8/1984 | Horiuchi et al. | 564/206 |
| 4,517,351 | 5/1985 | Szymanski et al. | 527/312 |
| 4,517,751 | 5/1985 | Ross et al. | 34/10 |
| 4,542,233 | 9/1985 | Raue et al. | 548/455 |
| 4,684,440 | 8/1987 | Penniman et al. | 162/184 |

FOREIGN PATENT DOCUMENTS

| | | |
|---|---|---|
| 1138247 | 12/1982 | Canada . |
| 1507595 | 4/1978 | United Kingdom . |
| 1574969 | 9/1980 | United Kingdom . |

OTHER PUBLICATIONS

Abstract of Russian Patent No. 372,305 (Nov. 1973).
Abstract of Russian Patent No. 674,249 (Jul. 1979).
Abstract of Russian Patent No. 1,018,709 (May 1983).
Abstract of Russian Patent No. 1,035,113 (Aug. 1983).
Abstract of Russian Patent No. 1,124,067 (Nov. 84).
Abstract of French Patent No. 2,501,066 (Sep. 1982).
Abstract of East German Patent No. 136,845 (Aug. 1979).

(List continued on next page.)

*Primary Examiner*—David A. Simmons
*Assistant Examiner*—Thi Tang
*Attorney, Agent, or Firm*—Pennie & Edmonds

[57] ABSTRACT

Novel pulp, paper and paperboard manufacturing methods utilizing water-insoluble organic hydrocarbons. These hydrocarbons can be introduced into the pressing operation of the pulp, paper, or paperboard making machine or can be substituted for water at any point prior to the end of the press section. The result is a significant saving in dryer energy which can be translated to greater productivity in dryer-limited processes. The result is a significant saving in dryer energy which can be translated to greater productivity in dryer limited systems. Functional chemical additives may be dissolved, dispersed or emulsified in the hydrocarbon and thereby introduced into the web. Much less functional chemical additive is required than with wet end addition.

15 Claims, 4 Drawing Sheets

U.S PATENT DOCUMENTS

Abstract of West German Patent No. 1,619,308 (Sep. 1970).
Abstract of West German Patent No. 1,769,404 (Jul. 1971).
Abstract West German Patent No. 3,021,838 (Dec. 1981).
Abstract of West German Patent No. 3,049,432 (Jul. 1982).
Abstract of West German Patent No. 3,235,527 (Sep. 1982).
Abstract of West German Patent No. 3,301,025 (Jul. 1984).
Abstract of West German Patent No. 3,316,880 (Nov. 1984).
Abstract of Belgian Patent No. 826,360 (Sep. 1975).
Abstract of Japanese Patent No. 70/027526 (Aug. 1970).
Abstract of Japanese Patent No. 71/004333 (Feb. 1971).
Abstract of Japanese Patent No. 71/034921 (Oct. 1971).
Abstract of Japanese Patent No. 73/009203 (Apr. 1973).
Abstract of Japanese Patent No. 48/056903 (Nov. 1973).
Abstract of Japanese Patent No. 48/099405 (Dec. 1973).
Abstract of Japanese Patent No. 74/033682 (Jun. 1975).
Abstract of Japanese Patent No. 75/016797 (Jun. 1975).
Abstract of Japanese Patent No. 75/020606 (Jul. 1975).
Abstract of Japanese Patent No. 50/138110 (Nov. 1975).
Abstract of Japanese Patent No. 51/018762 (Feb. 1976).
Abstract of Japanese Patent No. 51/040408 (Apr. 1976).
Abstract of Japanese Patent No. 51/082010 (Jul. 1976).
Abstract of Japanese Patent No. 51/109325 (Sep. 1976).
Abstract of Japanese Patent No. 52/066707 (Jun. 1977).
Abstract of Japanese Patent No. 54/055622 (May 1979).
Abstract of Japanese Patent No. 54/145299 (Nov. 1979).
Abstract of Japanese Patent No. 55/013732 (Jan. 1980).
Abstract of Japanese Patent No. 55/075404 (Jun. 1980).
Abstract of Japanese Patent No. 55/093899 (Jul. 1980).
Abstract of Japanese Patent No. 55/093900 (Jul. 1980).
Abstract of Japanese Patent No. 56/026095 (Mar. 1981).
Abstract of Japanese Patent No. 56/063007 (5/1981).
Abstract of Japanese Patent No. 58/023968 (Feb. 1983).
Abstract of Japanese Patent No. 58/036295 (Mar. 1983).
Abstract of Japanese Patent No. 58/105692 (Jun. 1983).
Abstract of Japanese Patent No. 53/056225 (Jul. 1978).
H. F. Rance, (ed.) Handbook of Paper Science Elsevier Scientific Publishing Co. The Netherlands (1980).
J. P. Casey (ed.) Pulp and Paper Chemistry and Chemical Technology, 3rd ed. John Wiley & Sons, New York (1980).
Encyclopedia of Chemical Technology, vol. 16, pp. 768-801 (1984).

METHODS FOR MANUFACTURING PAPER PRODUCTS

CROSS REFERENCE TO RELATED APPLICATIONS

This application is a continuation-in-part of application Ser. No. 77,149, filed Jul. 24, 1987, now abandoned, which is a continuation-in-part of application Ser. No. 806,884, filed Dec. 9, 1985, now U.S. Pat. No. 4,684,440.

TECHNICAL FIELD

The invention relates to novel methods for manufacturing pulp, paper and paper board products. Specifically, novel methods are disclosed for removing water from the paper product during post-formation, including consolidation, pressing and drying operations, as well as for introducing functional chemical additives.

BACKGROUND ART

All systems for manufacturing pulp, paper and paperboard include a series of operations and processes. Typically, wood is either digested chemically or ground up mechanically to form pulp. The chemical pulp must be washed and both grades are often bleached. Pulping, bleaching and washing are generally carried out in the pulp mill; subsequent operations take place in the paper mill.

In the preparation of paper from pulp stock, water contributes in several ways. In addition to providing a medium through which shear forces may be transmitted to the fibers during beating, water acts as a vehicle of suspension in which the fibers, having been well dispersed, can be brought together to give a sheet having the desired formation.

Refining is one of the last steps to take place prior to dilution with process white water to form headbox furnish.

Refining consists of pumping the pulp slurry through a series of metal discs moving at a high speed controllable by the papermaker. During refining, the cellulose fibers are, cut and macerated in order to develop fibrillation. This fibrillation increases the number of interfiber contacts during formation of the paper and bonding during subsequent pressing and drying operations. For example, a sheet that is formed from an unrefined pulp has a low density and is rather soft and weak. If the same pulp is well-refined, however, the resultant paper is much more dense, hard, and strong.

After refining, the pulp slurry is reduced in consistency by the addition of white water, prior to being pumped to the headbox. The concentration of solids in the headbox furnish is referred to as "consistency" and it typically ranges between 0.2 and 1%. In general, the lower the consistency the better the formation or homogeneity of appearance. Functional additives, usually in a cataionic form, can be added to the furnish so that they can be attached to, and retained by, fibers. In practice, they react sequentially with furnish components; first the soluble portion of the anionic trash, next the colloidal position, then the fillers, and finally the fines and fibers. As a result of the order of the sequential reaction, a large proportion of functional additive, often the major amount, is wasted and therefore not available to react with fibers since interaction with anionic trash is not useful. Additionally, retention of such cationic and wet end additives in the web can vary in a broard range up to about 80%, and the balance falls uselessly into the white water.

From the headbox, the furnish is pumped onto a wire which, on a modern machine, can be moving at a speed of about 700 to 2000 m/min.

Continuous sheet forming and drying can be accomplished using three different types of equipment: the cylinder, Fourdrinier (i.e., single wire), and twin-wire machines.

In the cylinder machine, a wire-covered cylinder is mounted in a vat containing the refined fiber slurry. As the cylinder revolves, water drains inward through the screen, thus forming the paper web on the outside of the cylinder. The wet web is removed at the top of the cylinder, passes through press rolls for water removal, and is then passed over steam-heated, cylindrical drying drums.

The Fourdrinier machine is more complex and basically consists of a long continuous synthetic fiber or wire screen (the "wire") which is supported by various means to facilitate drainage of water. The fiber slurry, which is introduced at one end of the machine through a headbox and slice, loses water as it progresses down the wire, thereby forming the web. The web is then directed to the press and dryer sections as in the cylinder machine.

The twin-wire machine is the latest development and consists essentially of two opposing wires. Twin-wire formers have replaced the Fourdrinier, particularly for lightweight sheets, e.g., tissue, towel, and newsprint. Twin-wire formers also are operated successfully on fine paper, corrugated media, and liner board grades. In twin-wire formers, the water is drained from the slurry by pressure rather than by vacuum. The two wires, with the slurry between, are wrapped around cylinder or set of supporting bars or foils. The tension in the outer wires results in a pressure which is transmitted through the slurry to the supporting structure; the pressurized slurry drains through one or both of the wires.

Subsequent to stock preparation and dilution, the paper furnish is usually fed to the headbox through one or more screens or other filtering devices to remove impurities. It then enters a flow spreader which provides a uniform flowing stream along the width of the paper machine. The flow spreader discharges the slurry into a headbox, where fiber agglomeration is prevented by agitation. Pressure is provided to cause the slurry to flow at the necessary velocity through the slice and onto the moving wire.

The wire is mounted over the breast roll at the intake end and at the couch roll at the discharge end. Between the two rolls, it is supported for the most part by table rolls, foils and suction boxes. A substantial vacuum is developed in the downstream nip between the table roll and the wire, and promotes water drainage from the slurry on the wire. As speeds increase, however, the suction can become too violent and deflect the wire, causing stock to be thrown into the air. A more controlled drainage action is accomplished by the use of foils. These are wing-shaped elements which support the wire and induce a vacuum at the downstream nip. Foil geometry can be varied to provide optimum conditions. After passing over the foils or table rolls, the wire and sheet pass over suction boxes, where more water is removed. Most machines also include a suction couch roll for further water removal.

In its most typical form, the formation of the paper web takes place in the first few feet on the screen of the papermaking machine. The stock issuing from the slice is a suspension of fibers in water, typically containing from 0.2 to 1.0% dry solids in a layer some 6-18 mm deep and up to several meters wide. It is deposited on, and drains through, an endless band of a woven synthetic fiber or metal fabric, called wire. At very low speeds, the force of gravity predominates in causing the drainage. At higher speeds, the action of gravity becomes negligible compared with the pumping action of the drainage elements (i.e., the table rolls or foils). A visible change occurs in the appearance of the stock as it proceeds down the wire when its concentration reaches about 2%. At this level, the surface ceases to appear mobile, loses its liquid sheen, and takes on a matte appearance. At this point in the process, the drainage elements are no longer effective for removing water because the web is formed. Next, consolidation begins, assisted by the action of the suction boxes. Some slight rearrangement of the fibers may still be achieved by the pressure of an overhead roller, called a "dandy" roll.

The sheet leaving the wet end has a consistency of 18-23%. Thus, it is possible to remove additional water mechanically without adversely affecting sheet properties. This is achieved in rotary presses, of which there may be one or several on a given paper machine. The press rolls may be solid or perforated and, often, suction is also applied through the interior of the rolls. The sheet is passed through the presses on continuous felts usually one and sometimes two for each press, which act as conveyors and porous receptors of water. The fiber content of the sheet can be increased by pressing to a consistency of about 30 to 40% without crushing.

Crushing, the direct flow of water in the sheet, occurs when too much pressure is applied to the wet sheet by the presses. Crushing can be minimized by applying pressure gradually, since less water is initially removed this way and the fibers are not so likely to be pushed apart. Also, crushing can be avoided by modifying the press rolls and felt construction to allow for increased water-removal rates. The sheet can stand higher and higher pressure as water is removed and the sheet becomes stronger. Graduated pressure is particularly important on heavy boards inasmuch as the danger of crushing increases for greater thicknesses of paper product. Pressing multicylinder boards while they are too wet may also lead to ply separation as well as crushing.

At a consistency in the range of 40+%, additional water removal by mechanical means is not feasible and evaporative drying must be employed. This is a costly process and often is the production bottleneck of papermaking. The dryer section usually includes a series of steam-heated cylinders. Alternate sides of the wet paper are exposed to the hot surface as the sheet passes from cylinder to cylinder. In most cases, except for heavy board, the sheet is held closely against the surface of the dryers by a fabric having carefully controlled permeability to steam and air. Heat is transferred from the hot cylinder to the wet sheet, and water evaporates. The water vapor is removed by way of elaborate air systems. Most dryer sections are covered with hoods for collection and handling of the air, and heat recovery is practiced in cold climates. The final consistency of the dry sheet is usually between about 92-96 weight percent, depending upon the type of paper product being manufactured.

The efficiency of the drying sequence is dependent upon such factors as the amount of applied pressure which squeezes the wet web between the felts, the efficiency with which water condensed within the dryer cylinder is physically removed, the nature and conditions of the carrier felt, if any, and the ventilation of the pockets between dryers. During the drying sequence, the consistency of the product is increased from the entry level of generally about 30-40% up to that of the emerging dry paper product, i.e., 92-96%.

The energy requirements for removal of water depend upon the form of water which is present in the paper product. A major portion of free water, that which exists over and above what is required to saturate the fibers, can be removed on the wire by gravity or suction. Interstitial water and an additional portion of the free water are removed by a pressing operation. The most tenaciously held water (i.e., that within the lumen and pores of the fiber wall) requires a significantly greater expenditure of energy for its removal, and this is generally accomplished utilizing thermal drying.

During the early stages of drying, the fibers are free to slide over one another, but as the free water is driven off, the fibers are drawn closer together and bonding begins to take place. Surface tension is primarily responsible for drawing together the fibers in this stage, but later, molecular attraction brings about the final bonding between fibers. No appreciable fiber-to-fiber bonding takes place until the consistency is raised above about 40 percent, but once this critical drying point is reached, shrinkage begins to take place and bonding begins.

In summary, the three steps which are necessary to form a final paper product from wood pulp all relate to the removal of water from the fiber or web. These include:

1) Depositing furnish, which may or may not contain functional additives, upon a screen (or "wire") to form a web of paper fiber. This step, known in its initial stage as "formation", is usually accomplished by extruding an aqueous dispersion of a low concentration of pulp (e.g., 0.2% to 1%) onto the screen. This screen, assisted in some cases by vacuum or suction, increases the consistency of the web to approximately 18 to 23 percent.

2) Compressing or squeezing the web in a "press section" to further remove water. This is usually accomplished by felted presses, a series of rollers each having at least over felted band for contact with the web. These felted presses remove additional free water and some capillary water, thus resulting in an increase in consistency of the web to a range of about 30 to 40 weight percent.

3) Drying the web utilizing steam-heated equipment in a "dryer section." Here, the remaining water content of the web is reduced to that desired for the final specific product, the consistency of which typically ranges between about 92 to 96 weight percent.

As mentioned above, the greatest energy use occurs during the drying of the paper product. For example, in the manufacture of thicker grades of paper product, such as board, in one case 88.6% of paper mill steam usage was reported to be at the drying cylinders.

Drying is a relatively expensive process, and the cost of drying is always a major part of the processing cost of the final paper, thus any significant savings in energy in the drying stage would directly result in significant cost savings.

SUMMARY OF THE INVENTION

The invention relates to a method for increasing the rate of water removal from a web of paper product during, pressing and drying which comprises treating the furnish or web with at least one water-insoluble compound prior to the end of the press section. This compound can be any water-insoluble liquid organic hydrocarbon or a water-insoluble liquid halogenated organic compound. Liquid water-insoluble hydrocarbons are most preferred. These liquid compounds will generally be referred to as hydrocarbons. This hydrocarbon can be applied "straight" (i.e., alone or in substantially pure form) or in the form of a water-in-hydrocarbon emulsion wherein the solvent forms the continuous phase. The treating step may also include adding a sufficient amount of hydrocarbon to the web to displace some of the water therefrom by preferentially rewetting the web upon exiting the press nip.

The web can be treated by a portion of the hydrocarbon prior to pressing and by a portion of the hydrocarbon during pressing. Alternatively, the hydrocarbon may be introduced continuously during pressing, and can be applied directly to the web or to the press section felt, thus being indirectly transferred to the web or applied upstream of the press section.

As noted above, the term "water-insoluble organic compound" is intended to include liquid organic hydrocarbons that are not soluble in water to any appreciable extent. These compounds are capable of replacing water from between the fibers of the web and are more easily removed than is water during the pressing and/or drying stages.

Preferred hydrocarbons are paraffinic, aliphatic, or aromatic organic compounds as well as halogenated hydrocarbons.

These methods also contemplate adding at least one functional chemical additive to the hydrocarbons for modifying or improving a property of the final product.

The term "water-insoluble organic compound" also includes certain functional additives which are insoluble in water but can be directly added to the web to achieve the improvements described above, along with the modification of one or more properties of the paper product. It is also possible to apply such water-insoluble functional additives in the form of a hydrocarbon solution, suspension or a water/functional additive in hydrocarbon emulsion where the hydrocarbon comprises the continuous phase.

The invention also relates to various improvements in a paper product manufacturing process which includes the steps of depositing pulp upon a screen to form a web of paper fiber, removing a portion of the water from the deposited web by pressing the web in press means having a felt press surface, and drying the pressed web. One improvement comprises treating the felt press surface with a sufficient amount of at least one water-insoluble hydrocarbon to displace water in the felt. The hydrocarbon then preferentially wets the web, providing an increased consistency exiting the press section and also thereby making the water more readily available for removal from the web during drying.

The hydrocarbon may be intermittently or continuously introduced onto the felt surface. As noted above, an additive for modifying or improving a property of the final paper product may be added to the hydrocarbon.

An alternate emodiment relates to increasing the rate of production of dry paper product by displacing water in the web with at least one water-insoluble hydrocarbon during the pressing step and increasing the quantity of press web which can be dried in the drying step. These improvements reduce the energy consumption for drying the web or increase the production rate for the same quantity of energy consumption. The prospect of substantially increasing production at the same level of energy consumption or substantially decreasing energy consumption offers a large economic incentive for adopting the methods of this invention.

Alternatively, the web can be treated by the hydrocarbon/additive or water/functional additive in hydrocarbon emulsion before pressing to obtain an improvement of a property of the final paper product. This embodiment provides the most efficient application of the additive. Such a property improving additive can include those for imparting greater wet or dry strength, better sizing, and changes in color or brightness with the use of the hydrocarbon or water/functional additive in hydrocarbon emulsion before or during pressing.

A further embodiment relates to an improvement in press means for partially removing water from a web of paper product. Such press means usually includes a felt surface for contact with the web, and the improvement comprises treating the felt surfaces of the press means with a sufficient amount of a water-insoluble hydrocarbon to at least partially displace water in the felt surfaces and in the web. This increases the amount of water removed from the web during the operation of the press means, resulting in a consistency increase of as much as 5 to 7% or more. Each 1% increase in consistency translates to a 5% energy savings in the dryer section. The reduction in dryer energy usage, or increase in productivity, can therefore be substantial.

Other aspects of the invention relate to papermaking systems which utilize water as a carrier for refining, processing, and transporting pulp and for forming a web of paper product in a paper product making apparatus. The apparatus usually has means for forming the web, means for depositing pulp upon the web forming means, press means for removing a portion of water from the web, and means for drying the web. The invention discloses an improvement which comprises substituting a water-insoluble hydrocarbon for water to increase the removal of water from the web during the pressing and drying steps. Alternatively, a water-insoluble hydrocarbon can be introduced onto the web during the pressing step to increase the removal of water from the web during the pressing and drying steps.

BRIEF DESCRIPTION OF THE DRAWINGS

The advantages in properties of paper sheets made according to this invention compared to those made by conventional methods are illustrated by the attached drawing figures wherein.

FIG. 2 is a graph of sizing vs. amount of chemical additive for paper sheets prepared from bleached groundwood pulp by the methods of the invention;

DETAILED DESCRIPTION OF THE INVENTION

Figure 1:
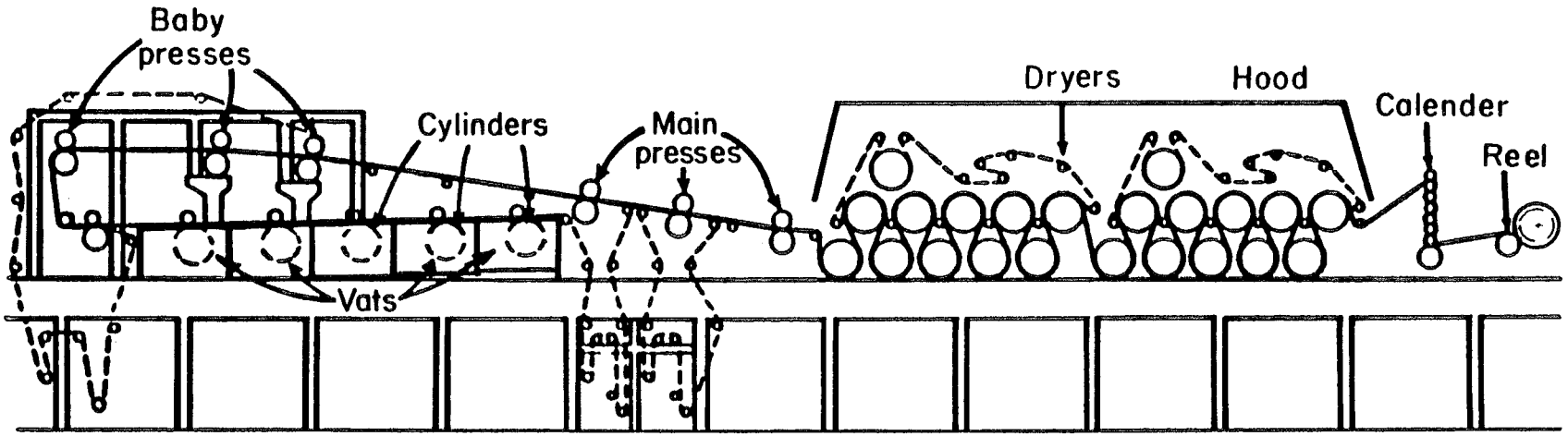
FIG. 1 (Prior Art)
FIG. 1 is an illustration of a typical Fourdrinier single wire paper-making machine.

The present invention generally relates to the application of a water-insoluble hydrocarbon to a web of paper before the end of the press section to preferentially wet the web and thereby displace water. The compound can also be applied to the web indirectly, such as to a press felt for transfer to the web. Thereafter, the web passes through a press nip, where water is pressed out of the web. When exiting the nip, the pressed web will try to reabsorb or be rewet by water, since all water cannot be removed by the press nip. According to the invention, however, the water-insoluble organic compound is preferentially taken up by the web as it exits the press nip because it has a lower interfacial tension than that of water, thus replacing water in the web. This achieves the same results as if increased amounts of water are removed from the web.

The economic effects of such increased water removal are a significant savings in energy consumption (i.e., on the order of about 15 to 40% in the drying section) or, because most operations are dryer limited, a substantial enhancement of productivity.

The use of the functional chemical additives with the hydrocarbon, in either a straight or water-in-solvent emulsion form, can provide improvements in the properties of the finished product when added prior to the end of the press section. Physical properties such as wet or dry strength, sizing, brightness, color and debonding-/apparent softness, can be incorporated by introducing one or more known papermaking chemical additives into the hydrocarbon prior to its application. The hydrocarbon and additives(s) are applied before the pressing step for maximum retention of additive in the web. With this procedure, it is possible to achieve nearly 100% retention of additive in the web, an amount which is substantially higher than that attainable by prior art methods for applying the additive.

Any water-insoluble organic hydrocarbon which is a liquid at ambient operating temperatures, can be utilized in the invention. This would include paraffinic, aliphatic, or aromatic organic solvents such as hexane, decane, kerosene, gasoline, benzene, toluene, and the like. Such solvents have much lower surface or interfacial tension, which enables preferential wetting of the web and concomitant displacement of water, thus reducing dryer energy usage during the subsequent drying step.

In addition, the preferred hydrocarbon should advantageously possess all of the following properties:

1) low water solubility;
2) low odor;
3) low toxicity;
4) low cost;
5) low vapor pressure;
6) low boiling point;
7) low surface tension; and
8) high solvency or KB value.

While hydrocarbons having any flash points can be used, the hydrocarbons having a relatively high flash point with an appropriate vapor pressure are desired in order to reduce to an acceptable level the possibility of fire or explosion. When low flash point solvents are used, proper precautions regarding fire or explosion hazards must be followed.

At this time, it is believed that a proprietary Exxon synthetic hydrocarbon, ISOPAR G, an aliphatic, isoparaffinic compound, is the most preferred hydrocarbon which has the best balance of these properties and meets most of the criteria for typical papermaking processes. It has a higher evaporation rate than water. Other straight chain unsubstituted aliphatic hydrocarbons having between 6 and 12 carbon atoms, or mixtures thereof, are also preferred. Odorless kerosene can be used, if desired. By observing the appropriate precautions, a wide range of other hydrocarbons provide similar results. Such hydrocarbons include halogenated (primarily chlorinated) organic compounds which are liquids over the temperature range of −20° to 150° C., such as ethylene dichloride or carbon tetrachloride.

Hydrocarbon solvents with a higher solvency (Kauri Butanol or KB Value) may be required to solubilize and transfer certain functional chemical additives to the web. The invention also contemplates the use of a combination of two or more hydrocarbons for this purpose and to maximize water displacement performance.

Preferably, the hydrocarbon alone (i.e., substantially pure hydrocarbon) is directly applied at any point in the process after the headbox. It can be directly applied to the web or to the felt surfaces of the press for transfer to the web. The amount of hydrocarbon utilized is not critical to the invention. The lower limit would be an amount sufficient to at least partially wet the web and replace water therefrom, so as to increase the rate of water removal in subsequent steps. The maximum amount of hydrocarbon utilized would be governed by economic considerations relating to the cost of the hydrocarbon and its contribution to reducing dryer energy usage by:

1) increasing the consistency of the web out of the press section,
2) creating an azeotrope with water, and
3) its much lower latent heat of vaporization compared to water. The economics of recycling the hydrocarbon must also be considered. Water-in-hydrocarbon emulsions can also be used to apply the hydrocarbon in the manner described herein.

The hydrocarbon can be introduced at any point in the papermaking process and before the end of the press section, usually after the headbox. If added in an appropriate amount to the web on the wire or in the press, an increase in consistency is achieved upon exiting the press section. This can amount to an increase of about 7 to 10% or greater on a high speed machine with substantial press section pressure. Over and above the consistency increase, it will also cause an increased rate of water removal in the dryer section. The combination of these two factors can result in a saving of as much as 40% of steam usage in the dryer section or, at the option of the papermaker, a major increase in product output.

Although hydrocarbons are more expensive than water, it is possible to recycle the hydrocarbon. Recovery of spent hydrocarbon can be accomplished by various means, such as carbon adsorption or through a condenser. After the hydrocarbon is separated from any water in the system, hydrocarbon is then reused. Other recovery methods known to those skilled in the art can also be used for recycling hydrocarbon.

One aspect of the present invention relates to the use of at least one water-insoluble organic hydrocarbon for treating the press felt. This treatment markedly increases the amount of water removal at this stage of the papermaking process. The result is that the drying time of the product, along with its corresponding energy requirement, are substantially reduced.

In normal press section operation the consistency, or solids content, increases to about 40%. The balance represents the approximate amount of liquid held within the web. Highly refined pulps can hold more water and once-dried pulps usually hold less. The use of water-insoluble organic compounds for treating the felt surfaces of the presses enables the paper product to have greater homogeneity and thus allows the product to be made thinner with better uniformity and strength. Also, a paper product is obtained that has better smoothness and this results in better printing properties.

The hydrocarbon can be applied to the felt intermittently or continuously. The application of the hydrocarbon to the felt can be accomplished by any of a variety of methods. This would include, for example, showering, spraying, or dribbling the hydrocarbon onto either side of the felt surface in a manner similar to that used for cleaning the felt. It may also be advantageously applied from the inside of a press section roll, and directed close to the nip so that the force of pressure can also be used to dispense water from the web. Also as noted above, the hydrocarbon can be applied in the form of an emulsion wherein the hydrocarbon is the continuous phase.

In a preferred embodiment, the hydrocarbon is continually applied to the felt such that a shutdown of the system is avoided. The amount of hydrocarbon used to wet the felt is not critical to the methods of this invention. From a practical standpoint, a minimum amount of hydrocarbon should be used in order to minimize the cost and quantity of hydrocarbon needed. The minimum necessary amount of hydrocarbon to be applied to the felt will depend upon the amount of paper product being contacted and can be routinely determined by one skilled in the art. The felt surfaces must be uniformly and partially wetted by the hydrocarbon for optimum results. Complete saturation of the felt surface by the hydrocarbon is counterproductive because the felt can no longer absorb water from the web. Some of the hydrocarbon must be transferred to the paper web to assist in the replacement of water.

Another aspect of the invention relates to the incorporation of various chemical additives into the hydrocarbon for application to the web to improve the properties of the final paper product. Such additives, which are generally known as functional chemical additives, are desirable for imparting various features into the paper products. According to the prior art, these additives are normally applied to the paper at the wet end of the paper making machine. These functional additives are conventionally introduced for the purpose of providing certain special properties to the finished product. They include: internal size, wet and dry strength agents, optical brighteners, pigments, dyestuffs, etc.

The uncertainty of obtaining a high level of uniform wet end retention of functional chemical additives conspires to impair runnability. Such a procedure is inefficient in that the amount of additive retained by the final paper product is less than 100%, and often relatively low because it is carried away in the white water which drains through the wire. Finally, wet end addition of functional additives is such an inefficient process that it is of severely limited value in many difficult systems high in anionic trash including those containing groundwood or recycled furnish.

The present invention includes the introduction of functional additives into the web directly or by the use of a water-insoluble organic hydrocarbon to dissolve, disperse or emulsify the additive. The application to the web of a solution, dispersion or emulsion of the hydrocarbon/functional additive, with or without water in the hydrocarbon, requires only a relatively small amount of hydrocarbon and functional additive, and offers the following advantages:

1. Functional additive usage can be reduced as much as one or two orders of magnitude.
2. A higher and more uniform level of quality results.
3. Costs can be lowered for two reasons:
   A. Increased retention of additive;
   B. Elimination of the cationicity requirement enables the functional additive to be supplied in a much cheaper form. For example, instead of a cationic starch-emulsified alkenyl-succinic-anhydride (ASA) internal size added at the wet end, the ASA can simply be dissolved in the hydrocarbon.

Remarkably good functional additive effectiveness can be obtained even in difficult or "dirty" systems. As examples, a high level of cost-effective sizing is now feasible in the presence of the "disturbing substances" or "anionic trash" currently found so difficult in Germany, and elsewhere; and in groundwood systems.

It is apparent that avoiding the wet end addition and the negative effects of both anionic trash and loss of additive effectiveness through imperfect retention enables a usage reduction of one or two orders of magnitude in functional additive as well as an improvement in the quality of additive distribution in the web. This technology shows every indication of fully meeting the neutral process sizing needs of the European paper industry, and eliminating the sham "pseudo-neutral" process.

Hydrocarbon-soluble functional additives may simply be dissolved in the hydrocarbon, as illustrated above.

Aqueous functional additives may be emulsified in the solvent to form a water-in-oil emulsion like mayonnaise. The textile industry has been practicing this technology for decades, as exemplified by pigment printing: an alkyd and melamine resin are combined with hydrocarbon to form the oil phase. The water-in-oil emulsion is applied to the fabric, dried, and heated to react the melamine resin with the alkyd and the cellulose, thereby forming a binder for the pigment. Functional papermaking additives which are normally supplied as aqueous dispersions may be similarly emulsified to form a "water-in-oil" emulsion for application to the web with the hydrocarbon.

The physical properties can be modified by the introduction of functional additives as described above. They may also be modified by the replacement of a portion of the hydrocarbon by a small amount of oxygenated hydrocarbon (e.g. isopropanol), to produce a thicker and much weaker sheet. This would appear to lend itself well to tissue operations, for example, because perceived softness would be enhanced without the use of de-bonding agents, so that re-processed broke would not detrimentally affect physical properties.

Many tissue machines burn the lint generated in the process of scraping the sheet off the Yankee dryer. The heat is usually conserved and put to good use. This would appear to represent an excellent set of conditions for use of an appropriate blend of hydrocarbons to improve water removal and perceived softness. The hydrocarbon vented through the exhaust system would be disposed of by burning and the heat conserved. It appears that the process could certainly be used safely for controlling sheet properties and introducing functional additives at the relatively low levels of solvent additional which are appropriate for those purposes.

EXAMPLES

The scope of the invention is further described in connection with the following examples which are set forth for the sole purpose of illustrating the preferred embodiments of the invention and which are not to be construed as limiting the scope of the invention in any manner.

EXAMPLE 1

Comparative

A paper sheet was made from a solution of bleached Kraft hardwood pulp having a consistency of 0.31% by the following procedure.

1. web formed
2. web pressed to 100 pounds
3. weight of pressed sheet recorded
4. sheet dried at 105° C. for one minute
5. sheet cooled in dessicator
6. weight of sheet recorded
7. steps 4, 5 and 6 repeated until the weight of the paper became constant.

The following table summarizes the data taken for 5 sheets.

TABLE I

| Properties of Sheet at Various Drying Times | | | |
|---|---|---|---|
| Drying Time (min.) | Weight of Sheet (g) | Consistency (%) | Moisture Content (%) |
| 0 | 3.73 | 38.2 | 61.8 |
| 1 | 3.23 | 44.1 | 55.9 |
| 2 | 2.77 | 51.3 | 48.7 |
| 3 | 2.36 | 60.3 | 39.7 |
| 4 | 2.00 | 71.3 | 28.7 |
| 5 | 1.70 | 83.7 | 16.3 |
| 6 | 1.51 | 94.1 | 5.9 |
| 7 | 1.44 | 98.6 | 1.4 |
| 8 | 1.43 | 99.7 | 0.3 |
| 9 | 1.42 | 100.0 | 0.0 |

The % consistency and % moisture were calculated by the following formulas:

$$\% \text{ consistency} = \frac{\text{dry weight}}{\text{wet weight}} \times 100\%$$

$$\% \text{ moisture} = 100 - \% \text{ consistency}$$

The Z directional strength was found to average 4.4 psi.

EXAMPLE 2

A paper sheet was made from a solution of a bleached hardwood Kraft pulp furnish having a consistency of 0.236% (i.e., a 0.236% dispersion of the pulp in tap water) according to the following procedure:

1) Add 500 ml of furnish to a handsheet mold such as The Dynamic Paper Chemistry Hand-Sheet Mold, available from Paper Chemistry Laboratory, Inc.; operate at 750 rpm for 5 seconds; then 500 rpm for 5 seconds.
2) Reduce speed to 200 rpm; lower jar approximately 1 inch; open valve and turn off impellor simultaneously.
3) When flow of water from jar stops, apply a vacuum of 10" Hg for additional water removal.

Remove vacuum when the pressure drops below 5" Hg.

4) Remove handsheet from the mold and place handsheet side down on a blotter. Press gently with hand, pull wire mesh screen from the handsheet.
5) Place handsheet, sandwiched between two sets of two blotters each, in a hydraulic press and apply 100 lbs of pressure for approximately 1 second.
6) Remove from press and weigh handsheet.
7)
   a. For Control samples: repeat step #5 and #6 twice;
   b. For samples treated with Isopar G: spray handsheet with Isopar G (an average of 1.122 grams); weigh; repeat step #5 and #6 twice.
8) Place handsheet in a 105° C. oven for one minute; remove; condition in dessicator for 15 seconds; weigh.
9) Place partially dried handsheet on the Williams Dryer until no further weight change is apparent (this completes the drying process more quickly than a 105° C. oven); condition in dessicator for 15 seconds; weigh.

The results were found to be:

| Time; min. at 105° C. | Consistency | |
|---|---|---|
| | Water | Isopar G |
| 0 | 49.0 | 47.8 |
| 1 | 57.7 | 57.9 |
| 2 | 67.3 | 66.6 |
| 3 | 74.5 | 78.5 |
| 4 | 90.1 | 93.8 |
| 5 | 94.7 | 99.6 |

The energy savings was calculated as 9.4% according to the following:

1) The dry handsheet weight divided by the weight obtained after partial drying, multiplied by 100, gives the consistency of the handsheet, expressed in percent.
2) A graph of time vs consistency can be plotted and a linear regression analysis obtained.
3) With the linear regression analysis the time in minutes necessary to reach 94% consistency is determined.
4) The difference between the time necessary for the control to reach 94% consistency, in this case 4.79, and the time necessary for the Isopar G treated handsheet to reach 94% consistency, 4.34, divided by the control time, multiplied by 100, gives the time difference between the two, expressed as a percent, and interpreted as energy savings, as follows:

$$\frac{4.79 - 4.34}{4.79} \times 100 = 9.4\%$$

The results are tabulated below:

TABLE I

| Properties of Sheet at Various Drying Times | | | |
|---|---|---|---|
| Drying Time (min.) | Weight of Sheet (g) | Consistency (%) | Moisture Content (%) |
| 0 | 2.98 | 47.8 | 52.2 |
| 1 | 2.36 | 60.3 | 39.7 |

TABLE I-continued

| Properties of Sheet at Various Drying Times | | | |
|---|---|---|---|
| Drying Time (min.) | Weight of Sheet (g) | Consistency (%) | Moisture Content (%) |
| 2 | 1.95 | 73.1 | 26.9 |
| 3 | 1.64 | 86.8 | 13.2 |
| 4 | 1.48 | 96.5 | 3.5 |
| 5 | 1.43 | 99.6 | 0.4 |
| 6 | 1.42 | 100.0 | 0.0 |

Figure 2:
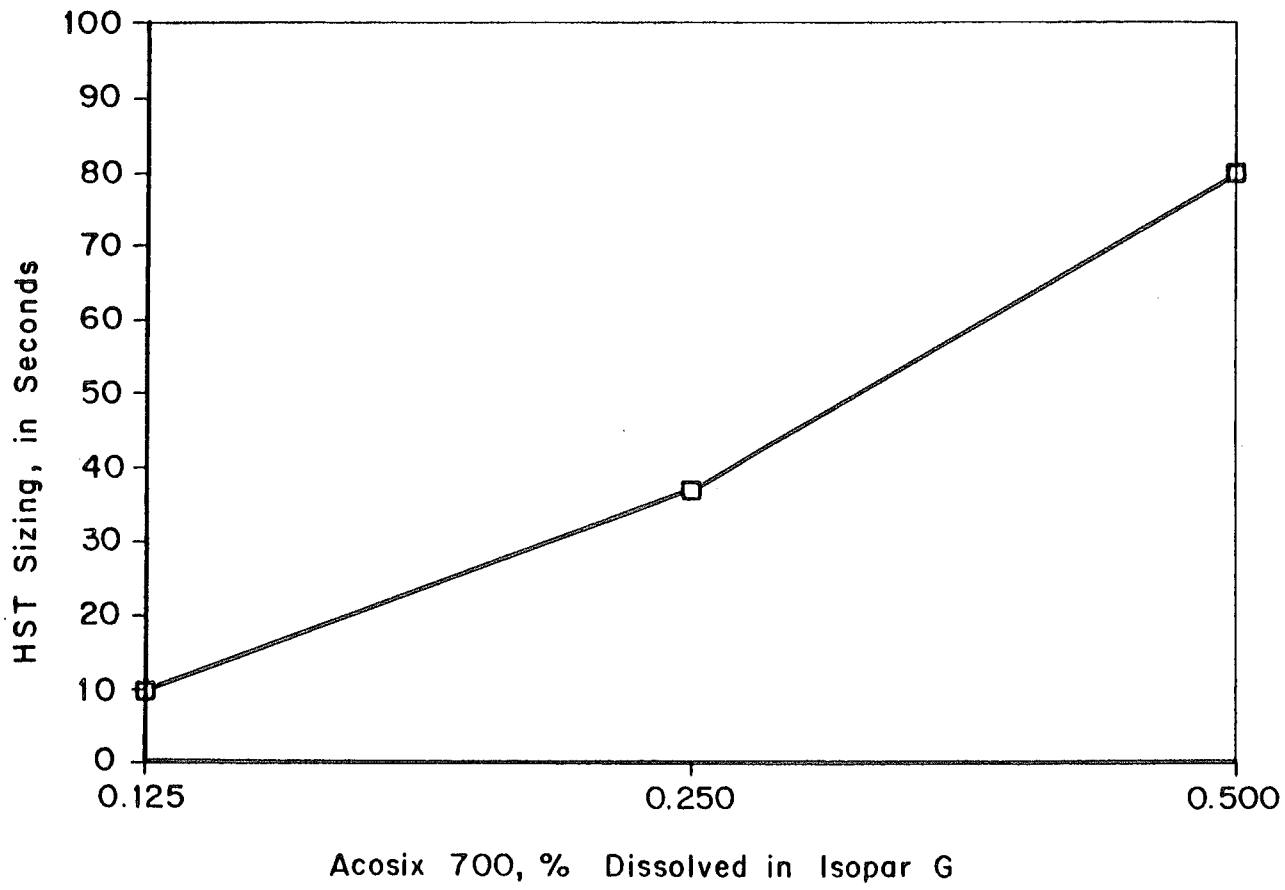
FIG. 2 is a graph of percent consistency vs. drying time for paper sheets prepared using both the method of the invention and the prior art.

A graphical comparison of the results of Examples 1 and 2 can be found in FIG. 2.

The Z directional strength of these sheets was found to average 6.4 psi. This is an increase of approximately 45% over sheets not treated with the solvent.

The amount of heat required to dry these sheets to 94% consistency was reduced by 36%. Part of the energy savings derives from the increase in consistency after pressing, from 38.2 to 47.8%. A significant part of the energy saving further derives from the increased rate of drying of the solvent-treated sheet, as shown by the inflection of the curve in FIG. 2.

In this particular case, 15% of the energy saving is derived from the increase in consistency after pressing, and 21% is derived from the inherently increased rate of drying, for a total of 36% energy saving.

EXAMPLE 3

A paper sheet was made from a solution of bleached groundwood pulp having a consistency of 0.25%. This sheet was then treated after formation with various solutions of Acosix 700 (Reichhold Chemicals), a pale, distilled tall oil containing 25–29% resin acids, in Isopar G (Exxon) hydrocarbon.

The specific conditions, solutions and results are as follows:

Alum at a ratio of 4:1 to the Accosix 700 in Isopar G was added to the furnish, the pH of which was adjusted to 5.1 with $H_2SO_4$.

| Acosix 700 percent | Alum percent | Hercules Sizing Test (HST), seconds; 1% Neutral Dye, 85% Reflectance |
|---|---|---|
| 0.125 | 0.5 | 10 |
| 0.250 | 1.0 | 37 |
| 0.500 | 2.0 | 80 |

The paper was immersed into each of these solutions for 5 seconds, then dried for 7 minutes at 105°C.

The results, graphically illustrated in FIG. 2, show that 100% groundwood sheets can be sized with this inexpensive water-insoluble organic compound.

EXAMPLE 4

Figure 3:
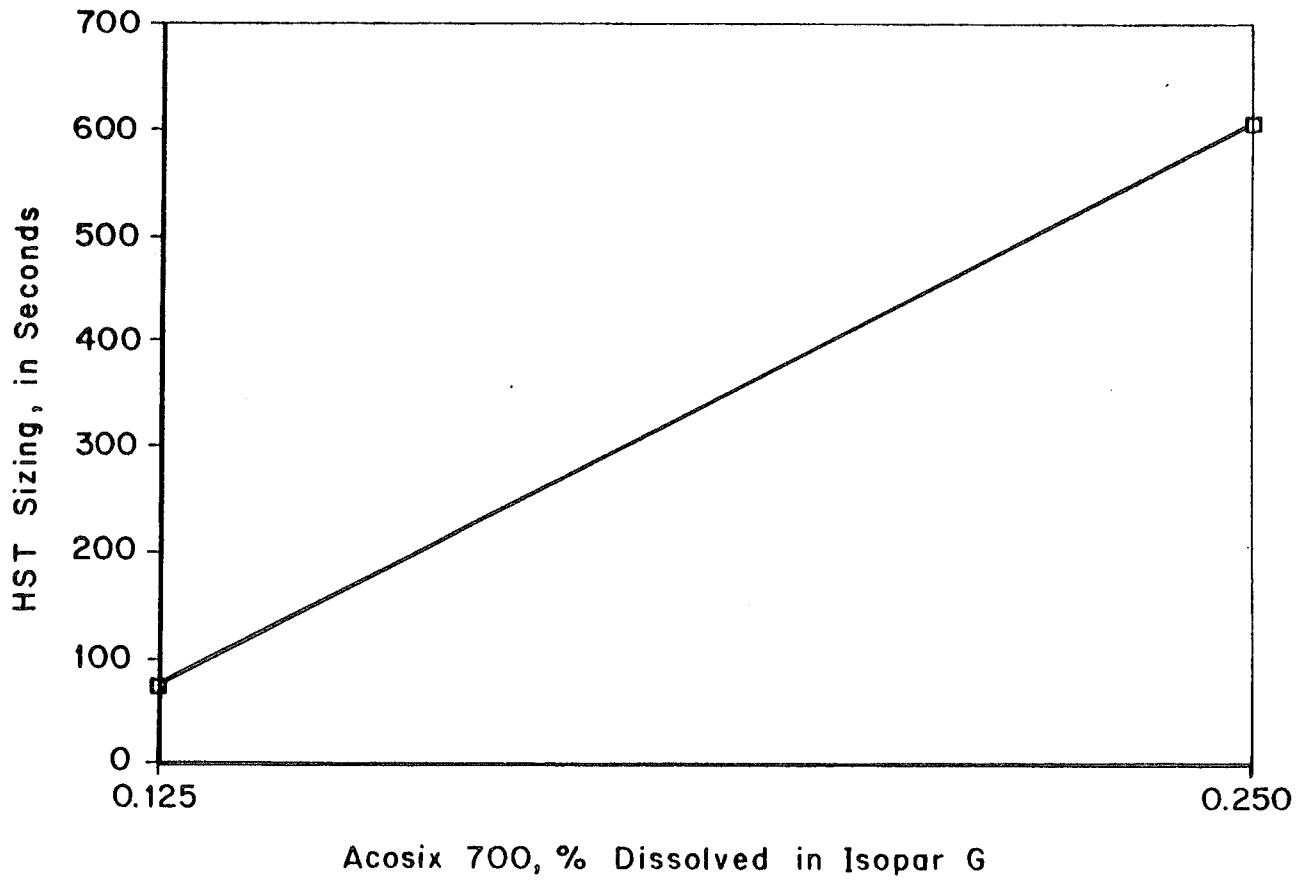
FIG. 3 is a graph of sizing vs. amount of chemical additive for paper sheets prepared from Kraft pulp by the methods of the invention.

Example 3 was repeated, except that a bleached Kraft hardwood pulp having a consistency of 0.23% was used. Conditions were the same, except that the sheet was dried for 5 minutes instead of 7. The results, graphically illustrated in FIG. 3, show that a woodfree sheet can also be sized by this procedure.

EXAMPLE 5

To determine the effect of press section nip pressure on sheet sizing, a paper sheet was made from a solution of bleached Kraft hardwood pulp having a consistency of 0.3%. 0.25% alum and 0.25% Cato F starch (National Starch) were added to the furnish. A solution of 0.25% ASA (alkenyl succinic anhydride-Humphrey Chemical) dissolved in Ismopar G was prepared. The sheet was immersed for 1 second and dried for 5 minutes at 105°C.

| Pressure, lbs. | Hercules Sizing Test (HST), seconds; 1% Neutral Dye, 85% Reflectance |
|---|---|
| 100 | 451 |
| 900 | *1000– |

*Over-sized; experiment terminated at 1000 seconds

Figure 4:
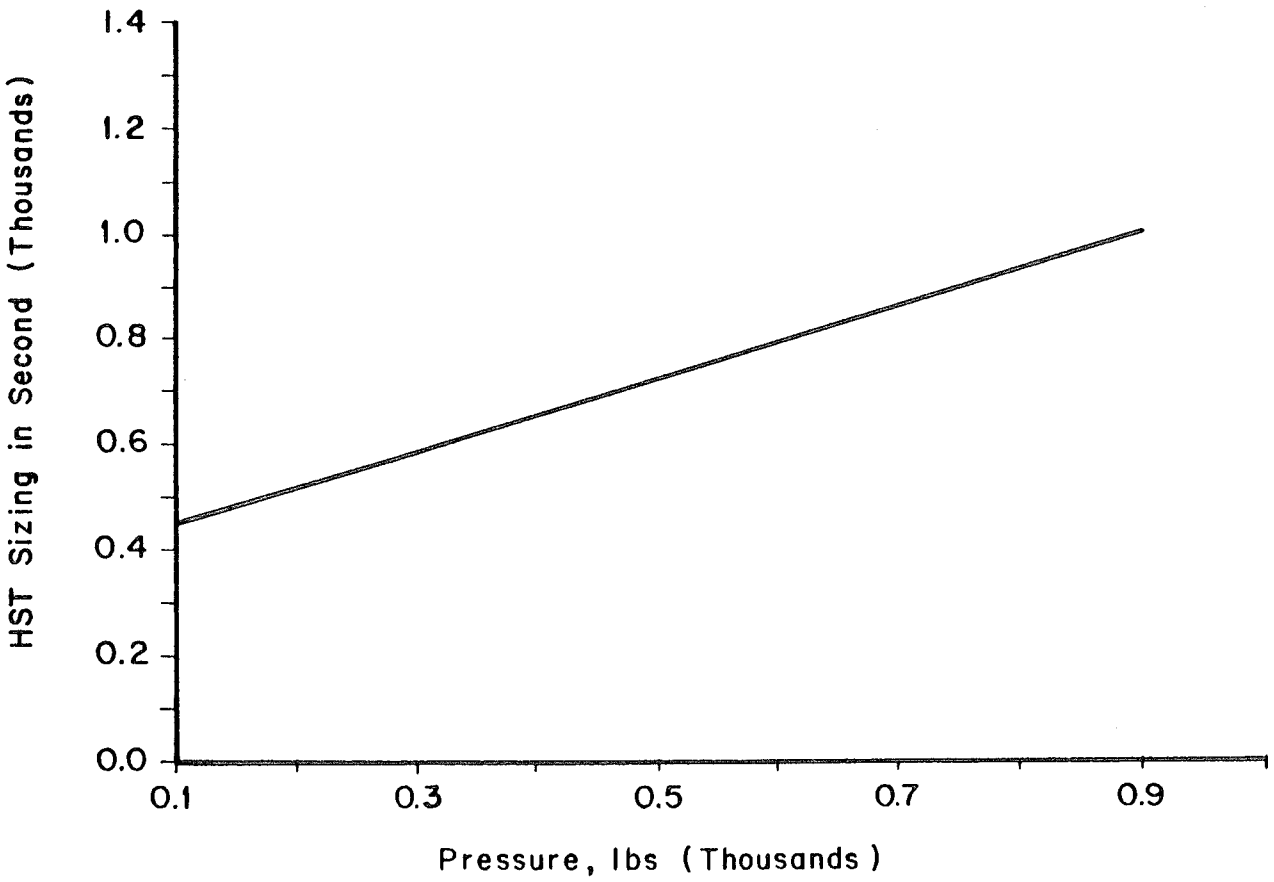
FIG. 4 is a graph of sizing vs. pressing pressure for a specific amount of an alkaline size introduced into paper sheets prepared by the methods of the invention.

These results, which are also illustrated in FIG. 4, demonstrate that in the ASA sizing of a free sheet, higher pressure results in better sizing, presumably due to the greater transfer of the solution to the web, with concomitant greater transfer of size, under the higher applied pressure.

Accordingly, Example 3–5 illustrate that groundwood or hardwood sheets can be sized with concentrations as low as 1–2 pounds/ton of internal size, while with conventional processes it is difficult or impossible to obtain such results.

What is claimed is:

1. A method for improving the rate of water removal of a paper product during its manufacture which comprises applying a solution consisting essentially of at least one water-insoluble liquid hydrocarbon at any point on a papermaking machine prior to the end of the press section in an amount sufficient to at least partially replace interstitial water in the web; and pressing the web in the press section to obtain a pressed web wherein some of the water has been replaced by hydrocarbon in order to improve water removal efficiency during the manufacture of the paper product.

2. The method of claim 1 wherein the hydrocarbon is applied to the web in an amount sufficient to increase the consistency of the web exiting the press section compared to a web to which the hydrocarbon has not been applied.

3. In a paper produce manufacturing method on a papermaking machine which includes the steps of depositing pulp upon a screen to form a web of paper fiber, removing a portion of the water from the deposited web by pressing the web in press means having a press felt surface, and drying the pressed web; the improvement which comprises applying to the press felt prior to its passing through a press nip a sufficient amount of a solution consisting essentially of at least one water-insoluble liquid hydrocarbon for transfer to the web to at least partially wet the web so that on exiting said press nip a pressed web is obtained whereby some of the water therein has been replaced by hydrocarbon in order to improve the water removal efficiency during the manufacture of the paper product.

4. The method of claim 1 wherein the hydrocarbon is applied to the web in an amount sufficient to increase the consistency of the web exiting the press nip compared to a web to which hydrocarbon has not been applied.

5. The method of claim 3 or 4 wherein the press felt surface passes through a plurality of press nips in the pressing stage and the hydrocarbon is applied to the surface of the press felt prior to entering each press nip.

6. A method for increasing productivity of a press or dryer section limited papermaking machine by increasing the efficiency of water removal from a web of a paper product during one of pressing and drying which comprises applying a solution consisting essentially of at least one water-insoluble liquid hydrocarbon at any point on a papermaking machine prior to the end of the press section in an amount sufficient to at least partially replace interstitial water in the web; and pressing the web in the press section to obtain a pressed web wherein some of the water has been replaced by hydrocarbon in order to improve water removal efficiency during the manufacture of the paper product.

7. The method of claim 6 wherein the hydrocarbon is applied to the web in an amount sufficient to increase the consistency of the web exiting the press section compared to a web to which hydrocarbon has not been applied.

8. The method of any one of claims 1, 2, 3, 4, 6 or 7 wherein the hydrocarbon incorporates a functional chemical additive which improves at least one physical property of the final paper product such as wet strength, dry strength, printability, softness, internal sizing, brightness or color.

9. A method for improving at least one physical property of a final paper product which comprises applying a solution, dispersion or emulsion consisting essentially of a least one functional chemical additive incorporated in a water-insoluble liquid hydrocarbon at any point on a papermaking machine prior to drying in an amount such that after the web passes through a press nip of a press section, said additive and hydrocarbon have replaced at least some of the water in the web, and drying the web to obtain a paper product having at least one physical property which is improved by said additive.

10. A method for increasing the efficiency of transfer of a functional chemical additive to a web which comprises applying a solution, dispersion or emulsion consisting essentially of at least one functional chemical additive incorporated in a water-insoluble liquid hydrocarbon at any point on a papermaking machine prior to drying, in an amount such that after the web passes through a press nip of a press section, said additive and hydrocarbon have replaced at least some of the water in the web with the efficiency of transfer of said additive to said web being increased compared to a web which is not treated with hydrocarbon; and drying the web to obtain a paper product having at least one physical property which is improved by said additive.

11. The method of claim 9 or 10 wherein the physical property of the final paper product to be improved is wet strength, dry strength, printability, softness, internal sizing, brightness or color.

12. The method of claim 9 or 10 which further comprises additionally treating the web with a hydrocarbon to reduce the amount of energy necessary to dry the web in a drying stage.

13. The method of claim 12 wherein the hydrocarbon is applied to a press felt before the press felt and web pass through a final press nip.

14. The method of claim 13 wherein the press felt passes through a plurality of press nips in the pressing stage and the hydrocarbon is applied to the press felt prior to entering each press nip.

15. The method of one of claims 1, 2, 3, 4, 6, 7, 9 or 10 which further comprises selecting the hydrocarbon from one of aliphatic hydrocarbons; aromatic hydrocarbons; halogenated organic liquids; or a water-in-hydrocarbon emulsion wherein the hydrocarbon forms a continuous phase.

* * * * *

UNITED STATES PATENT AND TRADEMARK OFFICE
CERTIFICATE OF CORRECTION

PATENT NO. : 5,114,539

DATED : May 19, 1992

INVENTOR(S) : Penniman et al.

It is certified that error appears in the above-identified patent and that said Letters Patent is hereby corrected as shown below:

On the title page, item [63], should read:

Continuation-in-part of Ser. No. 77,149, Jul. 24, 1987, abandoned, which is a continuation-in-part of Ser. No. 806,884, Dec. 9, 1985, now U.S. Patent No. 4,684,440.

Signed and Sealed this

Twenty-first Day of September, 1993

Bruce Lehman

*Attest:*

BRUCE LEHMAN

*Attesting Officer*

*Commissioner of Patents and Trademarks*